United States Patent [19]

Salo

[11] 3,930,757

[45] Jan. 6, 1976

[54] PRESSURE EQUALIZING PUMP

[76] Inventor: Eric A. Salo, 15898 Via Pinale, San Lorenzo, Calif. 94580

[22] Filed: Mar. 10, 1975

[21] Appl. No.: 556,815

[52] U.S. Cl. ..... 417/203; 415/122 A

[51] Int. Cl.[2] ..... F04D 17/08

[58] Field of Search ..... 417/64, 80, 76, 203; 415/203, 122 A, 121 R

[56] References Cited

UNITED STATES PATENTS

| | | | |
|---|---|---|---|
| 61,650 | 1/1867 | Ames | 415/122 A |
| 2,997,015 | 8/1961 | Richter | 415/122 A |

FOREIGN PATENTS OR APPLICATIONS

| | | | |
|---|---|---|---|
| 948,368 | 1/1919 | France | 415/122 A |

*Primary Examiner*—Henry F. Raduazo
*Attorney, Agent, or Firm*—Naylor, Neal & Uilkema

[57] ABSTRACT

A gear-driven transport ring rotates around a toroidal chamber. Spaced sealing rings carried by the transport ring divide the chamber into compartments which serve to transport liquid from a feed station to a discharge station. Gas or vapor pressure is employed at the discharge station to bring the liquid up to desired discharge pressure and to transport it to, for example, the feed water intake of a steam boiler.

4 Claims, 5 Drawing Figures

PRESSURE EQUALIZING PUMP

The essential object of the invention is to provide a high volume, high pressure, high speed pump which can be substituted for conventional centrifugal pumps to great advantage with reference to, for example, the operating power required, the elimination of cavitation and other wear problems, the prevention of the leakage of ambient air into the pump both at speed and at standstill.

These and other objects and advantages of the invention will be apparent from the following description taken in conjunction with the drawings forming part of this specification, and in which.

Figure 1:
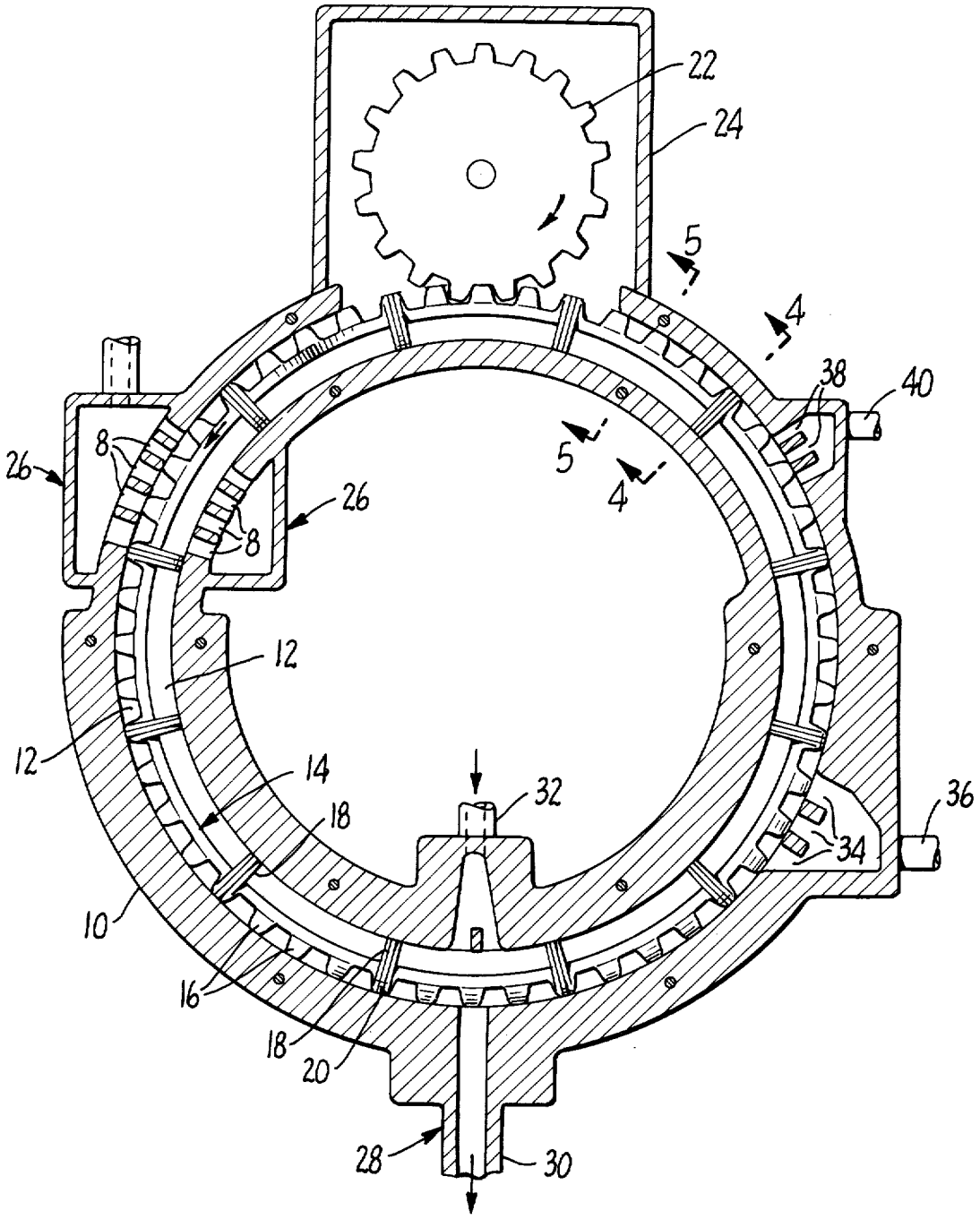
FIG. 1 is a view of the overall pump of the invention.
Figure 2:
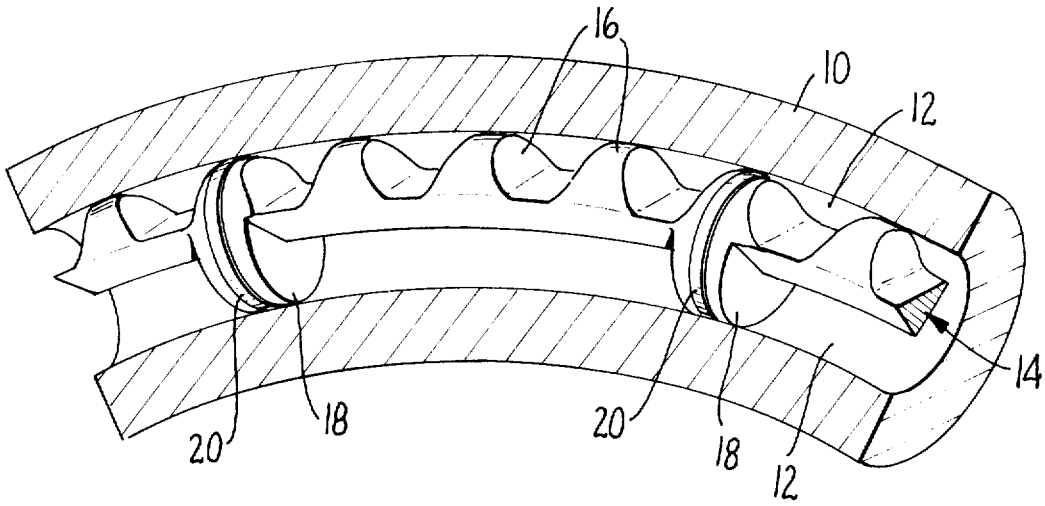
FIG. 2 is an enlarged view in perspective of the transport ring of the pump.
Figure 3:
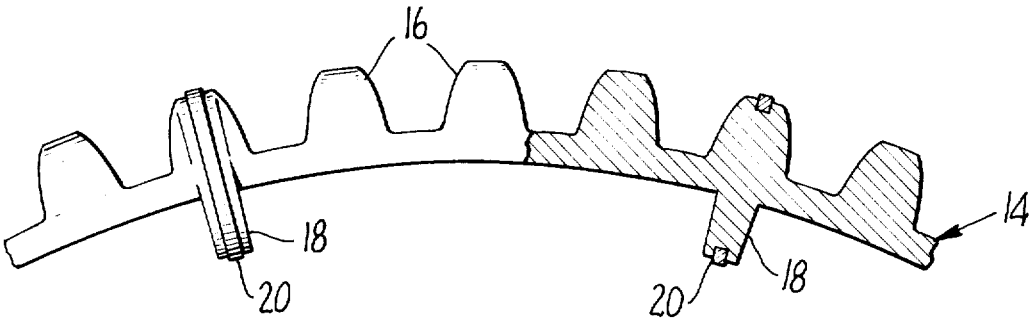
FIG. 3 is a view partly in elevation and partly in section of the transport ring.
Figure 4:
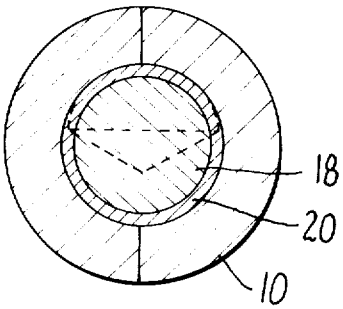
FIG. 4 is an enlarged detail view in section taken along lines 4—4 of FIG. 1.
Figure 5:
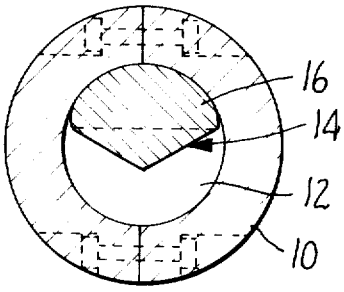
FIG. 5 is an enlarged detail view in section taken along lines 5—5 of FIG. 1.

Referring to FIG. 1, the pump comprises a toroidal casing 10 having defined therein a toroidal chamber 12. A transport ring indicated generally at 14 is slidably or rotatably disposed within the chamber 12. The ring 14 is provided with gear teeth 16 of involute design and with sealing discs 18 provided with expansible sealing rings 20. The discs 18 and rings 20 divide the chamber 12 into a continous series of volumetric pumping chambers.

The transport ring 14 is rotatably driven by spur gear 22 which is driven by a suitable motor or mechanical drive, not shown. The gear 22 is disposed within housing 24.

The pump is provided with a filling station 26 with which the volumetric chambers communicate through filling ports 8. For example, the feed chamber 26 may be supplied with feed water which is to be brought up to pressure by passage through the pump and then delivered by the pump to the feed water inlet of a steam boiler.

Counter-clockwise rotation of the transport ring in FIG. 1 moves the volumetric chambers from the feed station 26 to the discharge station 28 provided with discharge conduit 30. The liquid content of the volumetric chamber in communication with the discharge conduit 30 is brought up to pump discharge pressure by fluid pressure applied to the volumetric chamber through conduit 32. The pressure medium applied through conduit 32 may, for example, be steam from the mentioned steam boiler. This steam is therefore effective to bring the feed water up to pressure and feed it into the feed water side of the steam boiler. Such a pump as this is capable of high speed operation, and the pump liquid will therefore be discharged through conduit 30 under the combined effect of the pressure medium applied through conduit 32 and the centrifugal force caused by the rotation of the transport ring 14.

Further rotation of the transport ring 14 brings the volumetric chambers into communication through ports 34 and discharge conduit 36 with a suitable manifold system, not shown, for the discharge from the volumetric chambers and recovery of the high pressure gas within the volumetric chambers.

Further rotation of the ring 14 brings the chambers into communication through ports 38 with another manifold recovery system comprising conduit 40. Thus is the residual low pressure gas discharged from the ring chambers. This residual gas may be delivered to the drive housing 24 and the filling station housing 26 to provide a low pressure atmosphere therein of the medium being pumped and to prevent the influx of contaminants and ambient air.

The outer ends of the discs 18 are machined to form some of the gear teeth 16. The sealing or piston rings 20 are therefore located in part within the configuration of gear teeth. This pumping system has the following features and advantages, among others:

Fluid sealing is simply and efficiently provided by expansible rings which have proven their value in other environments and applications;

The buildup of static pressure is effected by the admission of pressurized vapor to compartments transporting the liquid being pumped;

The operation of the transport ring at higher speeds provides additional static pressure by way of the centrifugal force caused by rotation of the transport ring;

The leakage into the system of ambient air is completely prevented both at speed and at standstill by the pressure of vapor which is maintained above ambient pressure in all sections of the ring and bore;

Driving power for pumping is drastically reduced in comparison with conventional centrifugal pumps as increased pump output head is principally derived from the equalizing pressure of, for example, the steam from the steam boiler;

Vapor at lower pressures can be provided at regulated levels, e.g. at outputs 36 and 40, below the equalizing vapor pressure at conduit 32, thereby reducing the requirements for reducing stations and permitting higher efficiencies in many thermal plant cycles;

The independence of boiler and process plants from outside sources of power is made practical, either for standby or for start from complete shutdown;

The high pressure of pumped liquid is accomplished in a single rotating stage in contrast to the use of multiple stages in centrifugal pumps to obtain such high pressure;

Damage from the erosion caused by cavitation is completely eliminated;

A complete range of operating speed is provided from zero to maximum, there being no minimum speed required for effective performance;

No auxiliary liquids or fluids are needed for sealing or for recirculation at low flows, as is the case with centrifugal pumps;

Costly alloys are not required for wearing surfaces or to cope with cavitation problems.

What is claimed is:

1. Pumping apparatus comprising a casing, a toroidal chamber defined by a surface within the casing, said chamber having angularly spaced inlet and outlet openings a ring of reduced transverse cross-section disposed within the chamber, spaced discs on the ring, expansible rings carried by the discs and disposed in engagement with said surface, said discs and rings dividing said chamber into a plurality of separate compartments, and means to rotatably drive said ring around said chamber comprising gear teeth formed around said ring at one side thereof, each of said discs being formed in part by one or more of said gear teeth, said expansible rings being positioned within grooves formed in those teeth which form in part said discs.

2. The apparatus of claim 1 including a drive housing connected to the casing, and a drive gear rotatably mounted within the housing and disposed in mesh with the ring gear teeth.

3. The apparatus of claim 2 including a liquid input conduit angularly spaced from said housing and disposed in communication with said inlet opening of said chamber and successively with said compartments as they are moved thereby, a liquid output conduit angularly spaced from said input conduit and disposed in communication with said outlet opening of said chamber and successively with said compartments as they are moved thereby, and a pressurized fluid supply conduit adapted to be disposed in communication with said output conduit through said compartments successively to pump therefrom the liquid charges obtained from said input conduit.

4. The apparatus of claim 3 including one or more fluid discharge conduits angularly spaced from said fluid supply conduit and disposed in communication with said chamber and successively with said compartments as they are moved thereby enabling the venting from said compartments of pressurized fluid received from said supply conduit.

* * * * *